United States Patent [19]

Heerema

[11] 4,110,993

[45] Sep. 5, 1978

[54] APPARATUS FOR DRIVING PILES

[75] Inventor: Pieter Schelte Heerema, Kapellen, Belgium

[73] Assignee: Panama Overseas Shipping Corporation Inc., Panama, Panama

[21] Appl. No.: 812,976

[22] Filed: Jul. 5, 1977

[30] Foreign Application Priority Data

May 9, 1977 [NL] Netherlands ..... 7705067

[51] Int. Cl.[2] ..... E02D 13/04; E02B 17/00

[52] U.S. Cl. ..... 405/228; 173/45; 269/238

[58] Field of Search ..... 61/53.5, 94, 98, 63; 173/45; 269/238, 55

[56] References Cited

U.S. PATENT DOCUMENTS

| | | | |
|---|---|---|---|
| 1,482,396 | 2/1924 | Hansen | 173/45 |
| 3,483,708 | 12/1969 | Marshall | 61/53.5 |
| 3,991,581 | 11/1976 | Kolb | 61/53.5 |
| 4,052,047 | 10/1977 | Bailey | 269/238 |

*Primary Examiner*—Jacob Shapiro

*Attorney, Agent, or Firm*—Ladas, Parry, Von Gehr, Goldsmith & Deschamps

[57] ABSTRACT

An apparatus for driving piles into the sea-bottom for the support of a substructure resting on the sea-bottom of a working island to be installed comprises a plurality of support constructions attached to a column. Each support construction is provided with guide passage openings for the piles and the followers. The uppermost support construction consists of an arm which extends transversely of the column, and two semi-circular claw segments secured to the free end of the arm. One of the claw segments is pivotally mounted so that the claw segments can be brought into a closed position in which they define a guide passage opening for the pile or follower.

6 Claims, 10 Drawing Figures

PRIOR ART

APPARATUS FOR DRIVING PILES

The invention relates to an apparatus for driving piles into the sea-bottom for the support of a substructure resting on the sea-bottom of a working island to be installed.

So far use has been made of a plurality of support constructions rigidly connected with a column of the substructure, said constructions consisting of plates with guide passage openings positioned herein in a circle for the piles and the, followers, the number of guide passage openings corresponding with the number of piles to be driven, said guide passage openings being aligned. In order to obtain a sufficient length several followers may be temporarily connected with each other by means of the so-called Rockwell connections.

Before the driving proper can be started with, a plurality of all piles are lowered through the guide passage opening until they rest on the sea-bottom. It is also possible to position the piles in the guide passage openings during the fabrication of the substructure ashore. The length of the piles is determined by the driving depth and the required connecting length of the pile with the substructure. A usual connecting method consists herein that the pile is enclosed by means of a sand-cement mixture in a tubular jacket construction attached to the substructure.

By means of a follower temporarily positioned on the head of the pile and also guided through the guide passage opening, the pile is driven in by a pile driving hammer up to just above the upper side of the jacket construction. After the pile has been driven in to the desired depth the follower is hoisted up to above the uppermost guide passage opening and then lowered again through another guide passage opening on the head of a new pile to be driven in.

The disadvantage of this known apparatus consists herein that the crane standing on a ship or on the substructure itself should have a great hoisting height to lift the assembly of often very long followers up to above the uppermost guide passage opening, particularly when driving should be effected in always deeper water.

In order to eliminate this drawback an apparatus is suggested according to the invention with which the hoisting height of the crane is considerably reduced and the installation period considerably shortened.

In order to achieve the above-mentioned purpose it is suggested, in accordance with the invention, to design at least the uppermost support construction, attached to a column of the substructure, as a rotating arm which is provided at its extremity with two semi-circular claw segments capable of rotating in respect to each other and forming a guide passage opening on the closed position.

The advantage of this embodiment lies herein that the follower needs to be lifted only to just above the support construction which is not provided with a rotatable arm and has the described and known rigid guide passage openings, so that the hoisting height of the crane is considerably reduced and the efficiency of the pile driving is improved.

The invention will now be further elucidated by way of the description and the annexed drawings in which FIG. 1 shows a substructure of the support constructions known so far for the piles and the followers;

FIG. 2 is a diagrammatic plan view of the support construction represented in FIG. 1;

FIG. 3 gives a same view as FIG. 1, at least the uppermost support construction being constructed in according with the invention, however;

FIGS. 6*a* to 6*e* represent the introduction of a pile into the extremity of the arm of the support construction.

Figures 1, 2:
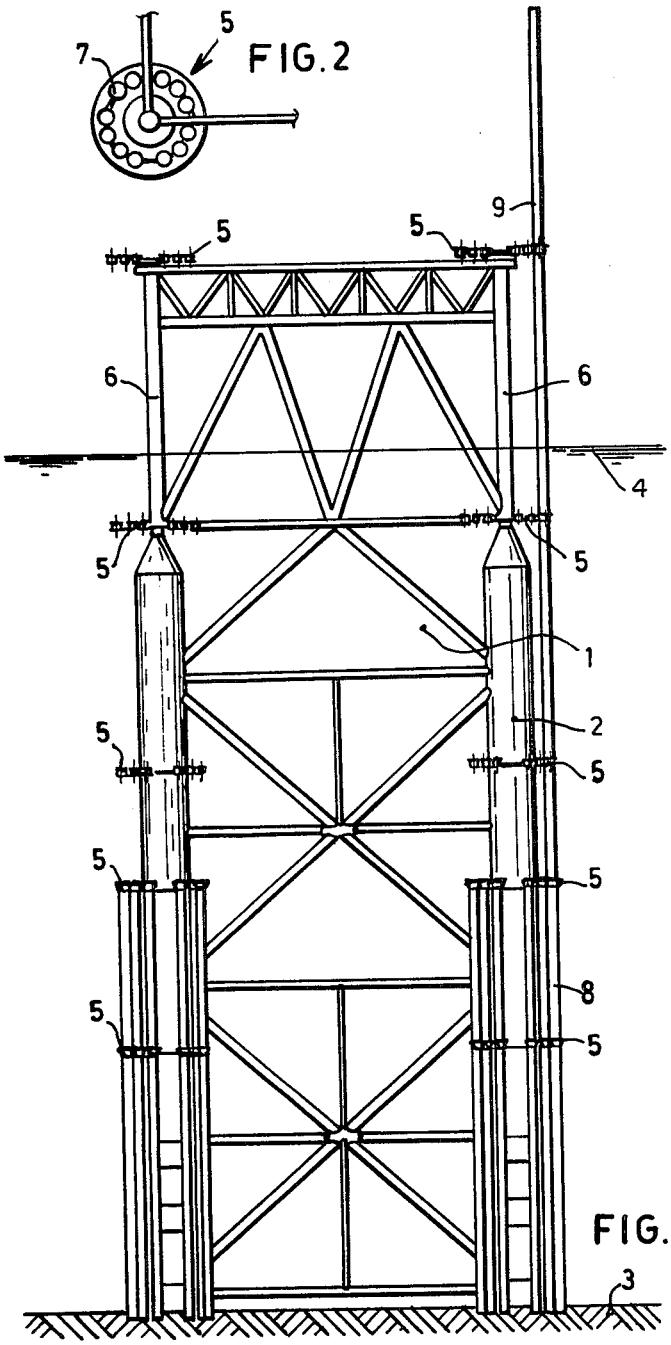
FIG. 1 PRIOR ART

In FIG. 1 the substructure of a working island to be installed is represented by the reference numeral 1. This substructure is supported on the sea-bottom 3 by means of columns 2. The water level is indicated by 4. Known support constructions 5 are attached to the columns 2 and the columns 6 attached hereto and located in the extension of columns 2. These support constructions 5 consist of a plate with passage openings 7 positioned herein in a circle to receive the piles 9 and the followers 9. These passage openings 7 are mutually aligned.

So far one operated as followed with the method applied up to now:

By means of a not-represented crane positioned on a ship or on the top of the substructure itself, the pile was lifted up to just above the uppermost support construction 5, whereupon it was lowered through the passage openings 7 of the various support construction 5 to the sea-bottom 3. Thereupon a follower 9 was lifted by the crane to just above the uppermost support construction 5 and then lowered through the passage openings of the various support constructions onto the head of the pile 8 to be driven in. Then the pile 8 was driven in to the desired depth by the pile driving hammer operating on the head of the follower 9. It is also possible that the piles 8 have been introduced into the support constructions 5 during the manufacture of the substructure ashore. It will be clear from what is said above that, particularly in case of pile driving in deep water the lifting height of the crane should be considerable to lift the lower end of the follower to above the uppermost support construction 5 before it is lowered onto the head of the pile 8 to be driven in via the various aligned passage openings.

Figure 3:
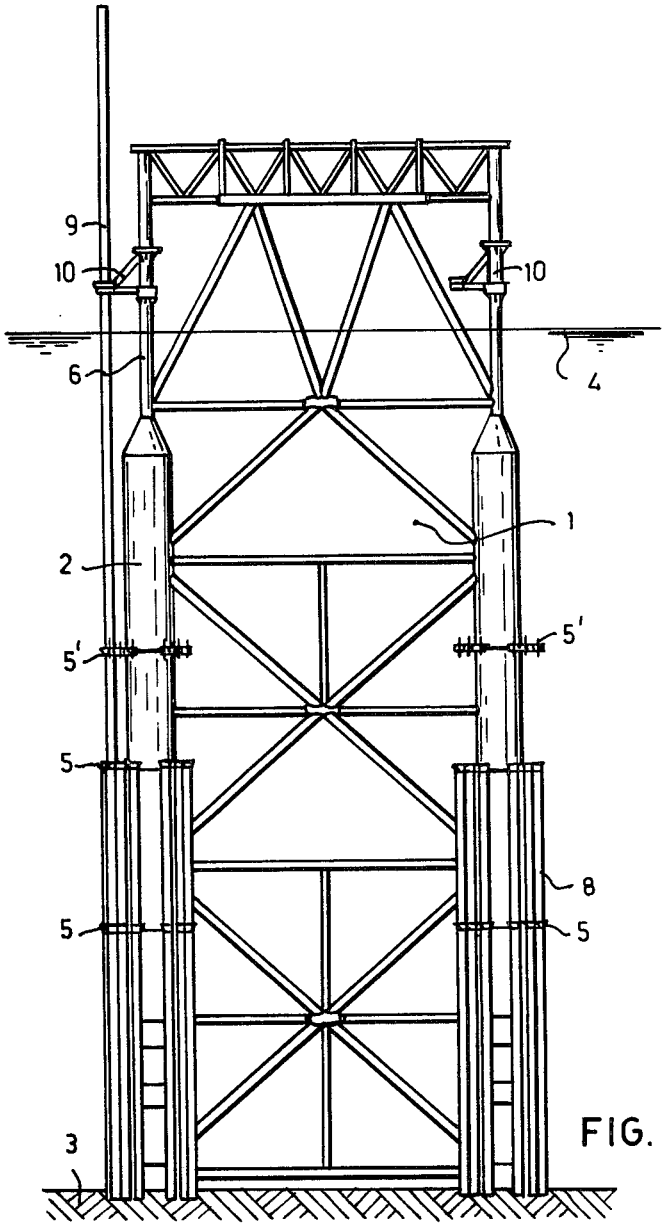
Figure 4:
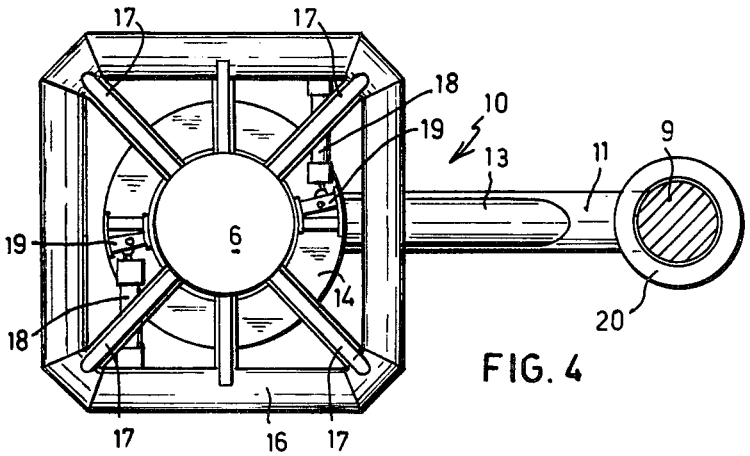
FIG. 4 is a plan view of the present support construction.
Figure 5:
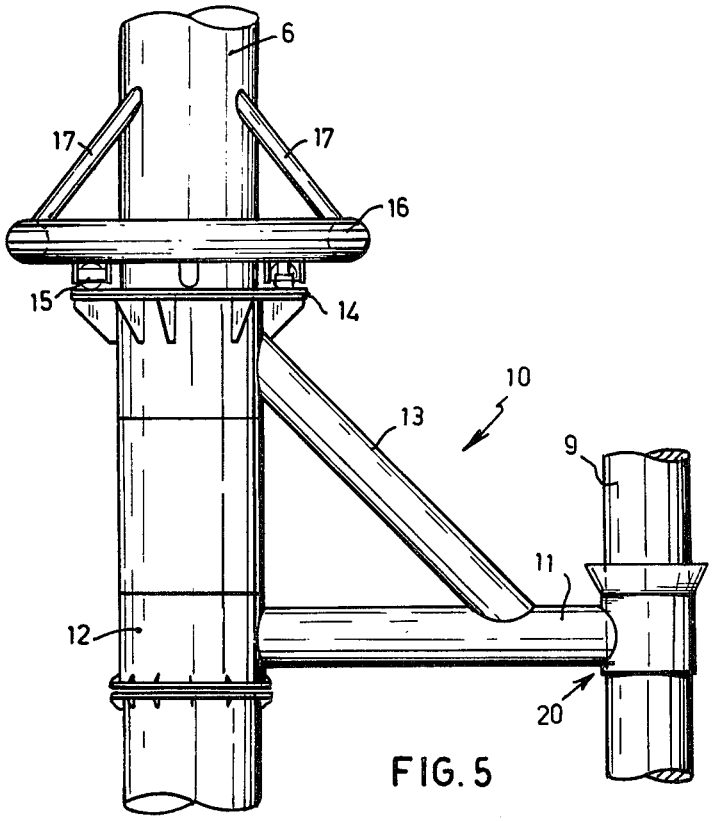
FIG. 5 is a view of the support construction represented in FIG. 4.
Figure 6A:
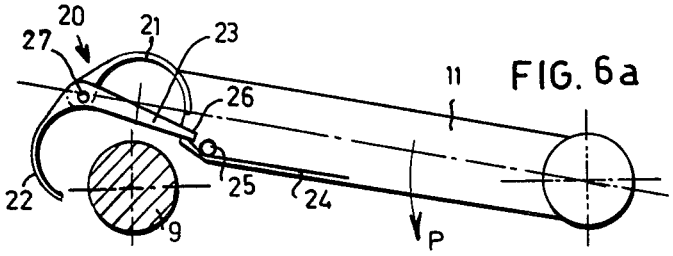
Figure 6B:
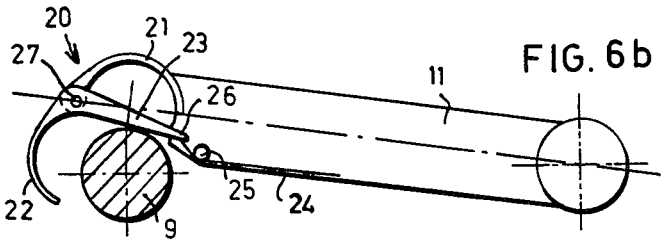
Figure 6C:
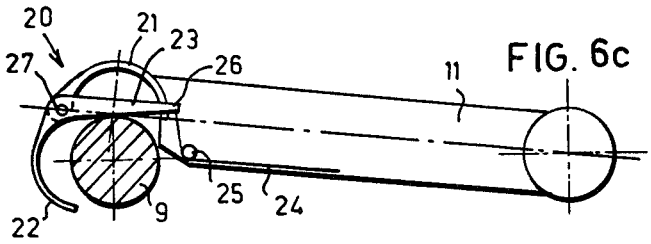
Figure 6D:
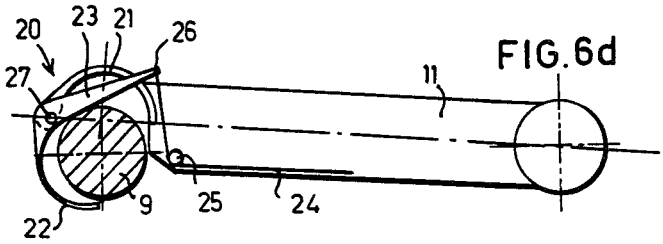
Figure 6E:
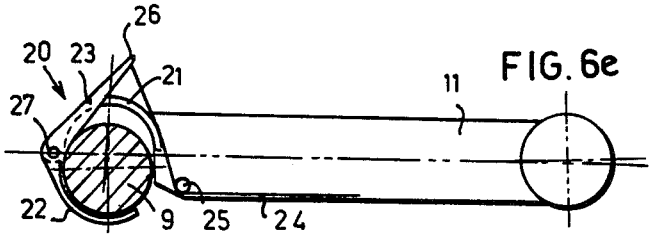

In order to obviate this drawback the present invention suggests a novel support construction 10 which is attached to a column of the substructure as indicated, e.g. in FIG. 3. An embodiment of this support construction is represented in FIGS. 4 and 5. As indicated by these FIGS. 4 and 5 the support construction 10 consists of an arm 11 which is attached to a tube 12 and is supported hereon by means of a strut 13. This tube 12 is located around the column 6 and is capable of rotating about it while supported. The top of the column 6 is provided with an annular flange 14. On this circumferential flange 14 a driving frame 16, stationary in respect of the column 6, rests by means of intermediate rolls 15, which frame by means of struts 17 is connected with the column 6. The rotation of the arm 11 about the column 6 can take place hydraulically, by way of a cable or chain, or by way of a rack cooperating with a gear ring. A plurality of jacks 18 is rigidly connected with the driving frame 16. A plurality of cams is present on the circumferential flange 14 with which the plunger extremity of the jack 18 can cooperate. In this way the arm 11 can be stepwisely rotated over a certain angle by cooperation of the jacks 18 with the cams 19.

As indicated particularly in FIGS. 6*a* to 6*e* the free extremity of the arm 11 has a receiving member 20 to receive a follower 9. This receiving member 20 consists of two semi-circular claw segments 21 and 22 of which the claw segment 21 is integral with the arm 11, the other claw segment 22 being pivotally in 27 with the first claw segment 21. From the pivot point 27 a rod 23 extends inwards which is rigidly connected with the rotating claw segment 22. The extremity 26 of the rod 23 opposite the pivot point 27 is connected with a cable 24 guided over a roll 25. By pulling this cable 24 the claw segment 22 pivots to the outside. When the arm 11 is rotated in the direction indicated by the arrow P the follower 9 abuts against the rod 23 and when the arm 11 is rotated further the rotating claw segment 22 closes around the follower 9 by the cooperation of the pile 9 with the rod 23 due to which, finally, a closed passage opening for the follower is obtained, this follower having been introduced before already in support constructions with stationary passage openings.

The driving of a pile 8, already introduced, takes place, e.g. as follows:

The arm 11 with its passage opening is aligned with a pile 8 to be driven in. By pulling the cable 24 the two claw segments 21 and 22 separate so that the follower 9 hoisted by a crane to just above the stationary support construction 5' (FIG. 3) can be introduced into the space released by the two claw segments. Suspended from the hoisting cable the follower will be pressing against the rod 23 cause the claw segment 22 to rotate until finally the follower 9 is completely enclosed by both claw segments as clearly shown in FIGS. 6*a* to 6*e*. Then the follower 9 is lowered onto the head of the pile 8, whereupon the driving in can start. As soon as the top of the follower 9 approaches the arm 11, the arm 11 can be rotated away and the further driving in can be continued. Thus driving can be effected with the pile driving hammer to just above the stationary support construction 5'.

Handy use can be made of the present support construction also when inserting the piles because also in this phase a considerable saving of the necessary lifting height for the crane is possible.

Of course, it is also possible to mount more than one support construction consisting of the rotating arm with the two claw segments along the column of the substructure due to which the required hoisting height again can be restricted.

Hereabove the driving in of piles has been described which are positioned in a circle around the columns of the substructure, however, when the piles to be driven in are positioned in a line, use also can be made of the present support construction which then is moved along a guide rail positioned on the top of the substructure.

Finally, it is also possible to drive in piles under an angle by means of the present support construction.

What is claimed is:

1. An apparatus for driving piles into the sea-bottom for the support of a substructure resting on the sea-bottom of a working island to be installed, comprising a plurality of support constructions attached to a column, said constructions each defining guide passage openings for the piles and the followers, and a chain located on a ship or on the substructure itself, at least the uppermost support construction consisting of an arm which extends transversely of the column and has first and second ends, means securing the first end of the arm to the column to enable the arm to pivot about a vertical axis, a first semi-circular claw segment secured to the second end of the arm, a second semi-circular claw segment, and means securing the second claw segment to said second end of the arm to permit pivotal movement thereof with respect to the first claw segment, whereby the claw segments can be brought into a closed position in which they define a guide passage opening for the pile or follower.

2. An apparatus as claimed in claim 1, wherein the first claw segment is integral with the arm and the second claw segment is secured to the first claw segment.

3. An apparatus as claimed in claim 2, wherein the second claw segment is provided with a rod portion rigidly connected thereto and extending from the pivot point into the space bounded by the first claw segment.

4. An apparatus as claimed in claim 3, further comprising a pull cable connected to the rod portion of the second claw segment to pivot the second claw segment away from the first claw segment.

5. An apparatus as claimed in claim 1, wherein the means securing the first end of the arm to the column comprise a tubular member defining an opening through which the column extends, the tubular member being provided with a circumferential flange at its upper end, and the apparatus further comprising a driving device which is rigidly connected with the column and rests on the circumferential flange through intermediate rolls.

6. An apparatus as claimed in claim 5, wherein the driving device is a hydraulic driving device.

* * * * *